United States Patent [19]

Alexy

[11] 4,313,267

[45] Feb. 2, 1982

[54] THERMAL INSULATION END PANEL ASSEMBLY FOR A PAPER MACHINE DRYER CYLINDER AND STUD CLAMP THEREFOR

[75] Inventor: Fred H. Alexy, Glen Falls, N.Y.

[73] Assignee: AMG Industries, Inc., Glens Falls, N.Y.

[21] Appl. No.: 147,648

[22] Filed: May 7, 1980

Related U.S. Application Data

[62] Division of Ser. No. 81,239, Oct. 2, 1979, Pat. No. 4,241,518.

[51] Int. Cl.[3] ..... F26B 13/04

[52] U.S. Cl. ..... 34/108; 34/110; 411/134; 24/243 B

[58] Field of Search ..... 24/248 SA, 263 A, 256, 24/243 B; 151/41.74, 44, 41.76; 85/32 K; 34/108, 110; 411/378, 107, 134, 135

[56] References Cited

U.S. PATENT DOCUMENTS

| | | | |
|---|---|---|---|
| Re. 19,386 | 11/1934 | Hand et al. | 24/243 B |
| 1,367,715 | 2/1921 | Malone | 151/44 |
| 2,082,366 | 6/1937 | Thompson | 24/243 B |
| 3,167,292 | 1/1965 | Meyerowitz | 24/243 B |

*Primary Examiner*—Larry I. Schwartz

*Attorney, Agent, or Firm*—Sughrue, Mion, Zinn, Macpeak & Seas

[57] ABSTRACT

A paper machine dryer cylinder mounts a plurality of circumferentially spaced stud clamps which project from the inside face of the panel, each stud clamp constituting a slotted, arcuate body with a screw spanning the slot to reduce the diameter of a central opening within the body and to which a dryer bolt head is clamped to fix the panel to the end face of the dryer cylinder to reduce heat loss axially of the cylinder.

2 Claims, 5 Drawing Figures

THERMAL INSULATION END PANEL ASSEMBLY FOR A PAPER MACHINE DRYER CYLINDER AND STUD CLAMP THEREFOR

This is a Division of application Ser. No. 81,239, filed Oct. 2, 1979 now U.S. Pat. No. 4,241,518.

FIELD OF THE INVENTION

This invention relates to the mounting of thermal insulation material end panels to the axial end faces of a heatable dryer cylinder for drying a paper web or the like passing over the periphery of the dryer, and more particularly to an improved mechanical clamping means for mechanically locking the end panel to the end face of the dryer cylinder.

BACKGROUND OF THE INVENTION

In view of the energy crisis, attempts have been made to reduce heat loss from processing machinery. In the area of paper manufacture or web drying, it is conventional to feed a wet paper web or the like over a series of cylinders which rotate about their axes and wherein means are provided for heating the periphery of the dryer cylinder so as to dry the web during transport. Conventionally, a large amount of heat is lost axially of the machine, that is, by radiation and convection at both ends of the machine dryer cylinder. Attempts have been made to mount thermal insulation material end panels to the cylinders and to thereby restrict convection and practically eliminate thermal radiation at the cylinder ends. The panels may be readily applied to a cylinder while in place, and in such case, the thermal panels normally are constructed of two or more segments, as for instance hemispheric sections. The sections are applied to the cylinder from opposite sides of the shaft mounting the cylinder for rotation, with the end panel sections being joined at their abutting edges by means of joint covers. In order to insure that the thermal panel will continue to overlie the axial ends of the machine dryer cylinders, means have been provided for coupling the face of the panel to the cylinder in a type of disconnect coupling or connection, permitting the end panels to be easily removed for machine maintenance and repair.

One such assembly involves the use of cuplike permanent magnets which are affixed to the face of the thermal insulation material panels with the cup cavities opening outwardly of the panel, and wherein the magnets are sized to the approximate diameter of the bolt heads which project from the end wall of the cylinder drum, such that the magnets are magnetically clamped to the bolt heads (and to the metal end plates for the cylinder). The permanent magnets are spaced on the panel at similar circumferential positions to the bolt heads projecting from the ends of the dryer cylinder such that when assembled, the magnets surround the bolt heads and magnetically lock the thermal insulation material end panel to the axial ends of the dryer cylinder.

While this method of assembly permits ease in removal of the thermal insulation material end panels from the end faces of the dryer cylinder, the coupling is not one which is positive in nature. The retention force is quite small, and there is no assurance that during operation inadvertently the thermal insulation material end panels will become disengaged, eliminating the thermal barrier and possibly interfering with machine operation, or in some cases, resulting in machine malfunction.

It is, therefore, a primary object of the present invention to provide an improved thermal insulation material end panel assembly which essentially prevents convection and radiation heat loss to a dryer cylinder bearing the same.

It is a further object of the present invention to provide an improved thermal insulation material end panel assembly which may be easily mounted and removed from the dryer cylinder, and in which a positive mechanical connection may be achieved with relatively high coupling strength, greatly reducing the possibility of separation of the panel from the cylinder during machine operation.

It is a further object of the present invention to provide an improved thermal insulation material end panel assembly which insures conservation of thermal energy, provides a cooler working environment, and which functions to insure uniform drying completely across the web of material to be dried as it passes over the dryer cylinder bearing the panels at opposite ends.

SUMMARY OF THE INVENTION

The invention is directed to the combination of a heatable dryer cylinder for drying a web passing over the peripheral surface of the dryer cylinder and a thermal insulation material end panel mounted on an axial end face thereof. The dryer cylinder bears a plurality of bolt heads which project axially from end faces thereof at spaced circumferential positions. A plurality of stud clamps fixed to the side of the thermal insulation material end panel and projecting axially therefrom at circumferential positions corresponding to the bolt heads are frictionally clamped to the bolt heads for mechanically locking the panel to the end of the dryer cylinder.

Each stud clamp comprises an arcuate clamping body including a radial slot extending outwardly from a circular opening within the body having a diameter slightly in excess of the diameter of the bolt head, a screw threadably extending transversely to the axis of the hole and threadably couples said sides of said body at said radial slot, so as to vary the diameter of the circular opening by closing off or opening the slot. A stud fixed to one side of the body and projecting axially therefrom is coupled to the panel. The circular opening receives the bolt head, and the screw reduces the diameter of the opening to mechanically frictionally lock the arcuate clamping body to the bolt head within the stud clamp opening.

Preferably, the stud terminates in an enlarged diameter disc whose diameter is slightly smaller than that of the hole, with the disc being welded along one edge to one-half of the arcuate body along the periphery of the opening within the arcuate body and being free of the other half of the arcuate body such that the stud clamp is free to open and close but provides the same axial center line for the stud as the dryer head bolt center line when connected thereto.

Preferably, the panel includes a tube assembly projecting through the panel from one side to the other, and the stud on the end opposite the disc projects through the tube assembly and bears a washer having an outside diameter in excess of the sleeve assembly tube and terminates in a threaded nut bearing on the washer and forcing the washer against the tube to lock the tube to the disc.

The invention is also directed to such stud clamps for clamping to bolt heads or the like, such that the stud center line corresponds to that of the bolt center line.

DESCRIPTION OF THE PREFERRED EMBODIMENT

Figure 1:
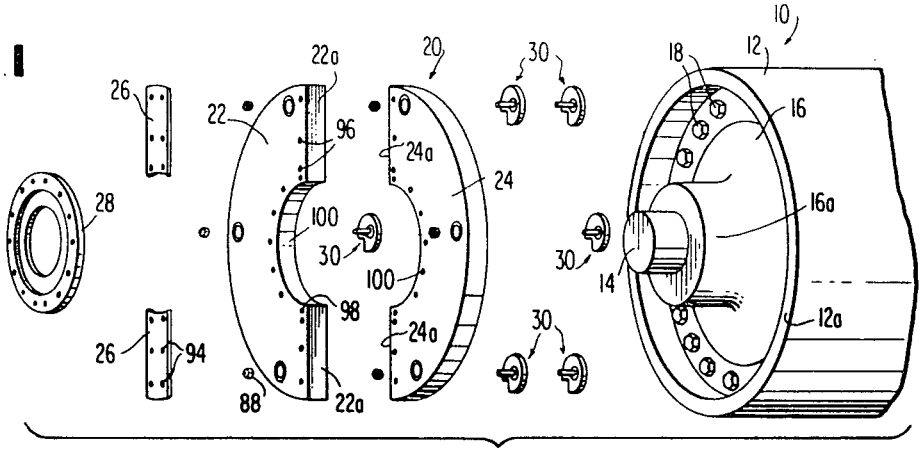
FIG. 1 is an exploded perspective view of the improved thermal end panel assembly for a paper machine dryer cylinder or the like and the stud clamps forming a portion thereof constituting a preferred embodiment of the present invention.

The present invention has particular application to heatable dryer cylinders for the drying of paper webs and the like, and in that regard, referring to FIG. 1, there is shown a portion of one such cylinder as indicated generally at 10, the dryer cylinder 10 including a metal cylindrical body 12 and being connected to a central shaft 14 for rotation about the shaft axis through end bells 16 which are coupled to the body 12 by means of a plurality of bolts indicated generally at 18 and which form a circumferentially spaced array on the end bell 16 and facing axially outwardly of the dryer cylinder 10.

Referring further to FIG. 1, the thermal panel indicated generally at 20 comprises an assembly of two arcuate thermal panel sections or halves as at 22, 24, the sections including faces as at **22*a*, 24*a* which abut each other and when coupled together by way of joint covers 26, form a ringlike assembly which surrounds a projecting hub portion 16*a* of the end bell 16. The thermal panel 20 thermally blocks a major portion of heat from escaping from the ends of the dryer cylinder 10, either by way of radiation or convection. A seal ring 28 is applied to the joined sections 22, 24, receives the projecting shaft 14, and acts to assist in thermally sealing off the heat trying to escape from the ends of the dryer cylinder, with most thermal insulation coming from the panel halves 22, 24**.

A very important aspect of the present invention are the stud clamps indicated generally at 30, FIG. 1, which function to mechanically lock the thermal panel 20 to the end bell 16 of the cylinder 10, and in this case within the recessed end of the cylindrical body 12. In this embodiment, the end bell 16 is axially remote from the edge **12*a* of the cylindrical body 12 so as to form an annular recess 32. It is within this recess 32 that the thermal panel 20 resides. The panel 20 is symmetrical about a joint line as defined by the abutting end faces 22*a*, 24*a* of panel halves 22 and 24, respectively. The assembly of the end panel and its coupling to the dryer cylinder may be visually appreciated by reference to FIGS. 1, 2 and 3. The thermal panels 20 defined by sections 22 and 24, are formed of sheet metal as hollow casings but bear heavy thermal insulation internally as seen in FIG. 3. In that regard, the panel section 24 comprises an outer metal shell 34 and an inner metal shell 36. The shells 34 and 36 overlap each other slightly as at 38 and are filled with a suitable thermal insulation material as at 40. The panel halves 22, 24 are formed in mirror image fashion and each includes a plurality of spacers of tubular form as indicated generally at 42. In that respect, the sheet metal shells 34 and 36 bear circular holes as at 44 and 46. The spacers 42 constitute telescoping tubes as at 48 and 50, being welded together as at 52 and being peripherally notched as at 54 and 56, respectively, within which the edges of the sheet metal shells 34 and 36 are received. This locks the spacers 42 in proper axial position within the thermal panel halves. Further, the telescoping tubes 48 and 50 form a shoulder as at 58, defined by the end of tube 50. Further, the other end of tube 50 extends beyond the sheet metal shell 36 of the panel half. End 60 projects beyond the sheet metal section shell 36 of the thermal insulated metal panel sections 22 and 24**.

Figure 4:
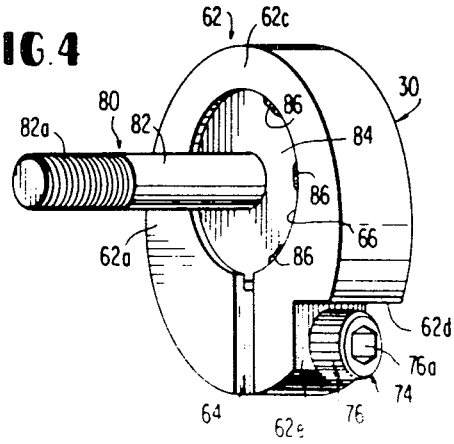
FIG. 4 is a perspective view of the improved stud clamp of the present invention.
Figure 5:
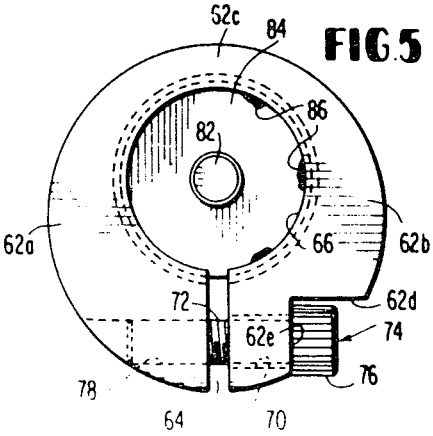
FIG. 5 is a front end view of the improved stud clamp of FIG. 4.

In order to lock the panel halves to the end bells 16 at both axial ends of the dryer cylinder 10, the present invention advantageously employs specially formed stud clamps, as indicated at 30, FIG. 1. FIGS. 4 and 5 show a stud clamp more fully. Each stud clamp 30 is formed principally by an arcuate clamping body 62 in the form of an arcuate or slotted ring bearing a slot 64 which extends radially from an offset circular opening or hole 66 within the body, on the thickened side of the body 62. The narrowmost part of the arcuate body occurs diametrically opposite slot 64. The opening or hole 66 is on the order of the diameter of the bolt head 68 of mounting bolt 18 employed in mounting the end bells 16 to the cylindrical body of each dryer cylinder 10, but terminates short of one side forming an annular lip or rim 67.

Referring again to FIG. 4, the arcuate body 62 therefore forms two halves, a left half **62*a* and a right half 62*b*, with the halves being movable slightly towards and away from each other by flexing at the narrowmost portion 62*c* of that body. One of the body halves has its periphery recessed as at 62*d*, and that half is drilled at the recess so as to form a transversely extending hole 70 through which passes the threaded shaft portion 72 of a socket head adjustment screw, indicated generally at 74. The head 76 of the screw abuts face 62*e* defined by recess 62*d* within which the hole 70 is bored. The opposite or left side 62*a* is tapped and threaded at 78 so as to receive the threaded end of the shaft portion 72 of the screw 74. As may be appreciated, by positioning of a suitable hex-shaped tool within the opening 76*a* of head 76 of the screw, the screw 74 can be rotated such that the shaft 72 projects more or less within the tapped and threaded hole 78 within the body section 62*a*, thus causing the body sections to come together at the slot 64**, and narrowing that slot gap.

The stud clamp 30 is completed by a headed stud indicated generally at 80 and comprised of a shaft portion 82 being threaded at **82*a* on an outer end, and bearing at its opposite end a thin metal disc 84 having a diameter slightly less than the diameter of the opening 66 within the body 62. The body 62 is provided with the circular opening 66 almost the full thickness of that body. However, the annular rim 67, FIG. 3, outlines a circular hole 69 which is of slightly less diameter than that of hole 66 and is of a diameter in excess of the diameter of the disc 84 received within hole 66. The disc 66 is welded at three circumferentially spaced locations as at 86, to the rim of one of the halves, in this case half 62*b* of arcuate body 62. The right hand edge of disc 84 is therefore fixed to the body half 62*b*, and when the adjustment screw 74** is rotated counterclockwise, FIG.

4, looking in from the head, the axis of the disc and therefore the axis of the stud shaft 82 tends to shift and to move slightly relative to the left hand section half 62*a* as slot 64 gap enlarges. This also enlarges the diameter of the opening 66 which receives the bolt head 68 during coupling of the stud clamp to the bolts 18. Each stud clamp stud shaft 82 preferably carries an MF two-way lock nut 88 and a washer 90, the washer 90 having an outside diameter less than the internal diameter of tube 48 but being in excess of the internal diameter of tube 50 such that it abuts the shoulder 58, when a given panel half such as panel half 24 is mounted thereto by causing the stud 80 to enter the cylindrical opening of spacer 42.

Previously, it is necessary to fasten the stud clamps to the individual heads 68 of the mounting bolts 18 which mount end bell 16 to the dryer cylinder at both ends. The socket head screws 74 are tightened down on the bolt heads 68, and then a given half as at 24 of the thermal panel is impaled over the clamp studs 80 and loosely fastened with the lock nuts 88 and washers 90.

Figure 2:
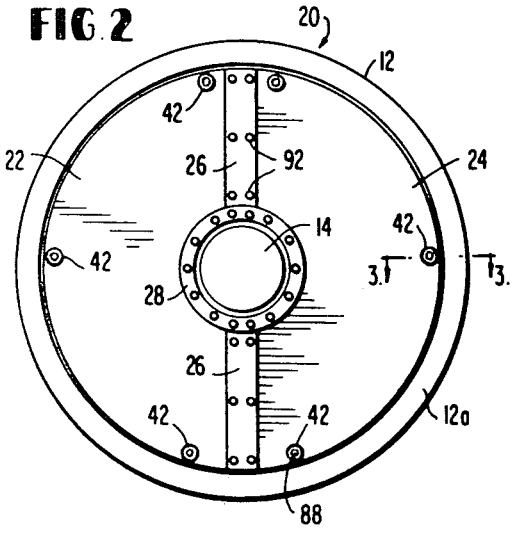
FIG. 2 is an end view of the assembly illustrated in FIG. 1.
Figure 3:
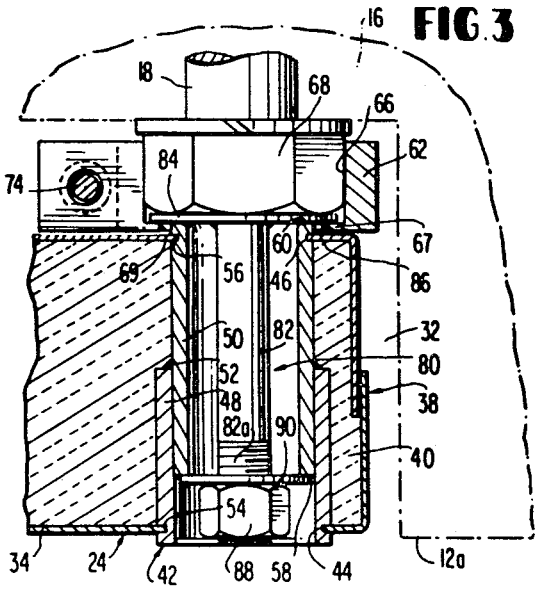
FIG. 3 is a horizontal sectional view of a portion of the assembly of FIG. 2, taken about line 3—3.

This is followed by the mating half, as for instance half 22, being mounted to the left side of the dryer cylinder via its three spacers as indicated at 42, FIG. 2. Subsequent to the loose fastening by way of lock nuts and washers 88, 90, and with both panels 22 and 24 in place, the panel halves are mechanically locked together through the use of the two joint covers 26. Screws 92 pass through openings 94 within the joint covers and with the screws 92 received within mounting holes 96 adjacent the flattened end faces 22*a*, 24*a* of respective sections or halves 22, 24. Subsequently, the seal ring 28 is mounted to the panel by the use of further screws 92 which pass through the seal ring, and are received within screw holes 98 provided within the panel sections or halves 22, 24 adjacent the arcuate cut outs 100 of those members. With the two joint covers 26 securely fastened to both halves of the thermal panel 20, final tightening of the stud clamp stud lock nuts 88 occurs. This completes the installation of one thermal panel to one end of the dryer cylinder 10. The opposite end is similarly treated.

While the invention has been particularly shown and described with reference to a preferred embodiment thereof, it will be understood by those skilled in the art that various changes in form and details may be made therein without departing from the spirit and scope of the invention.

What is claimed is:

1. A stud clamp for clamping an element carried thereby to a protruding bolt head or the like, said stud clamp comprising:

an arcuate clamping body bearing a circular opening on the order of the bolt head diameter for receiving said bolt head and bearing a radial slot opening radially outwardly from said circular opening to form two body halves, a screw threadably coupling opposite sides of said body at said slot permitting an increase or reduction in diameter of the circular opening by forcing opposed clamping body halves at said slot to move towards and away from each other to releasably clamp said bolt head to said body, and a stud fixed to said body at one side thereof overlying said circular opening and projecting axially of said circular opening and away from said circular opening for coupling of said stud clamp to said element.

2. The stud clamp as claimed in claim 1, wherein said stud bears at one end thereof and axially centered thereon, a disc having a diameter smaller than the diameter of the circular opening of said clamping body, said disc being welded along one edge only to one half of said body, within said circular opening, and to one side of said slot, and being free of the other half of said body within said circular opening on the opposite side of said slot, such that said stud presents no interference to said screw threadably coupling opposite halves of said body at said slot when effecting variation in diameter of said circular opening as a result of screw rotation.

* * * * *